US008778134B2

(12) United States Patent
Vehvilainen et al.

(10) Patent No.: US 8,778,134 B2
(45) **Date of Patent: *Jul. 15, 2014**

(54) PROCESS FOR PRODUCING MICROFIBRILLATED CELLULOSE

(75) Inventors: Marianna Vehvilainen, Tampere (FI); Taina Kamppuri, Tampere (FI); Maarit Peltola, Helsinki (FI); Ali Harlin, Kerava (FI); Pertti Nousiainen, Tampere (FI)

(73) Assignee: Stora Enso OYJ, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 13/382,573

(22) PCT Filed: Jul. 2, 2010

(86) PCT No.: PCT/IB2010/053043

§ 371 (c)(1),
(2), (4) Date: Mar. 12, 2012

(87) PCT Pub. No.: WO2011/004300

PCT Pub. Date: Jan. 13, 2011

(65) Prior Publication Data

US 2012/0160433 A1 Jun. 28, 2012

(30) Foreign Application Priority Data

Jul. 7, 2009 (SE) ..... 0950534

(51) Int. Cl.
*D21C 1/00* (2006.01)

(52) U.S. Cl.
USPC ..... 162/9; 162/24; 162/25; 162/28

(58) Field of Classification Search
USPC ..... 162/24
See application file for complete search history.

(56) References Cited

U.S. PATENT DOCUMENTS

| | | | | |
|---|---|---|---|---|
| 3,310,459 | A * | 3/1967 | Guthrie | 162/12 |
| 3,382,140 | A | 5/1968 | Henderson et al. | |
| 4,481,076 | A | 11/1984 | Herrick | |
| 4,634,470 | A * | 1/1987 | Kamide et al. | 106/204.01 |
| 5,129,987 | A | 7/1992 | Joachimides et al. | |
| 5,731,080 | A | 3/1998 | Cousin et al. | |
| 6,425,975 | B1 | 7/2002 | Viikari et al. | |
| 6,670,469 | B1 * | 12/2003 | Beyer et al. | 536/56 |
| 7,297,224 | B2 | 11/2007 | Nakamura et al. | |
| 2001/0011516 | A1 | 8/2001 | Cantiani et al. | |
| 2003/0234088 | A1 * | 12/2003 | Phipps | 162/29 |
| 2005/0000666 | A1 | 1/2005 | Taylor et al. | |
| 2005/0167059 | A1 * | 8/2005 | Staton et al. | 162/21 |
| 2006/0289132 | A1 | 12/2006 | Heijnesson-Hulten | |
| 2009/0061484 | A1 * | 3/2009 | Scott et al. | 435/69.1 |
| 2010/0065236 | A1 | 3/2010 | Henriksson | |
| 2010/0272819 | A1 * | 10/2010 | Engelhardt et al. | 424/494 |
| 2012/0135506 | A1 * | 5/2012 | Heiskanen et al. | 435/277 |

FOREIGN PATENT DOCUMENTS

| | | | |
|---|---|---|---|
| EP | 1036799 | 9/2000 | |
| WO | 9318111 | 9/1993 | |
| WO | WO 01/96402 | * 12/2001 | C08B 1/00 |
| WO | WO0196402 | 12/2001 | |
| WO | 03033815 | 4/2003 | |
| WO | 2004055267 | 7/2004 | |
| WO | WO2004055268 | 7/2004 | |
| WO | WO 2007/091942 | * 8/2007 | D21C 9/00 |
| WO | WO2007091942 | 8/2007 | |
| WO | 2008033283 | 3/2008 | |
| WO | 2010015726 | 2/2012 | |

OTHER PUBLICATIONS

Vehvilainen, Marianna; Kamppuri, Taina; Rom, Monika; Janicki, Jaroslaw; Ciechanska, Danuta; Gronqvist, Stina; Siika-Aho, Matti; Christoffersson, Kristina Elg; Nousiainen, Pertti. "Effect of Wet Spinning Parameters on the Properties of Novel Cellulose Fibres." Cellulose, (2008) vol. 15, No. 5, pp. 671-680.

Paakko, M; Ankerfors, M; Kosonen, H; Nykanen, A; Ahola, S; Osterberg, M; Ruokolainen, J; Laine, J; Larsson, P T; Ikkala, O; Lindstrom, T. "Enzymatic Hydrolysis Combined with Mechanical Shearing and High-Pressure Homogenization for Nanoscale Cellulose Fibrils and Strong Gels." Biomacromolecules (2007), vol. 8, No. 6, pp. 1934-1941.

Henriksson M; Henriksson G; Berglund, L A; Lindstrom, T. "An Environmentally Friendly Method for Enzyme-Assisted Preparation of Microfibrillated Cellulose (MFC) Nanofibers." European Polymer Journal, (2007), vol. 43, No. 8, pp. 3434-3441.

Svagan, A J; Samir, M A S A; Berglund L A. "Biometric Foams of High Mechanical Performance Based on Nanostructured Cell Walls Reinforced by Native Cellulose Nanofibrils." Advanced Materials (2008), vol. 20, No. 7, pp. 1263-1269.

Vehilainen t al., "Effect of wet spinning parameters on the properties of novel cellulosic fibres," Cellulose (2008), 15:671-680.

Paakko et al, "Enzymatic Hydrolysis Combined with Mechanical Shearing and High-Pressure Homogenization for Nanoscale Cellulose Fibrils and Strong Gels," Biomacromolecules 2007, 8, 1937-1941.

Svagan et al., "Biomimetic Foams of High Mechanical Performance Based on Nanostructured Cell Walls Reinforced by native Cellulose Nanofibrils," Adv, Mater, 2008, 20, 1263-1269.

Zhou et al., "Review of Microfibrillated Cellulose (MFC) for Papermaking," 2007, Pulp and Paper Engineering, School of Chemical and Biomolecular Engineering Georgia Institute of Technology, http://www.tappi.org/Downloads/Conference-Papers/2007/07NAN/07NAN18.aspx.

Cellulase Analytical Method, 2011, Enzyme Development Corp., http://www.enzymedevelopment.com/wp-content/uploads/2011/10/Cellulase-ECU-UNCO.pdf.

(Continued)

*Primary Examiner* — Richard Crispino
*Assistant Examiner* — Eric Yaary
(74) *Attorney, Agent, or Firm* — Greer, Burns & Crain, Ltd

(57) ABSTRACT

A process for treating cellulosic fibers comprises mechanically pre-treating the fibers followed by treating the fibers with an enzyme and thereafter mixing the fibers with a solution comprising an alkali metal hydroxide followed by mechanically treating the fibers to form microfibrillated cellulose. In this way it is possible to produce microfibrillated cellulose (MFC) in an improved and energy efficient way.

18 Claims, No Drawings

(56) References Cited

OTHER PUBLICATIONS

Smook, Gary A., Handbook of Pulp and Paper Terminology, 190, Angus Wilde Publications, Inc., p. 129, 1990.

International Search Report and written opinion issued in PCT/IB2011/052063, dated Sep. 6, 2011.

Institutionen for Pappersteknik KTH, "Pappersteknik," 1992, second edition, ISBN 91-7170076-5, pp. 446-447.

International Search Report and Written Opinion issued in PCT/IB2011/052064, dated Sep. 22, 2011.

Ankerfors, "Microfibrillated cellulose: Energy-efficient preparation techniques and key properties," Licentiate Thesis 2012.

Ankerfors et al., "On the Manufacture and Use of Nanocellulose," 9th International Conference on Wood and Biofiber Plastic Composites, 2007.

Siro et al., "Microfibrillated cellulose and new nanocomposite materials: a review," Cellulose (2010) 17: 459-494.

Ahola, "Properties and Interfacial Behaviour of Celluose Nanofibrils," Doctoral Thesis, TKK Reports in Forest Products Technology, Series A4, Espoo 2008.

Written Opinion issued in PCT/IB2010/053043, dated Sep. 29, 2010.

International Search Report and written opinion issued in PCT/IB2010/053044, dated Sep. 29, 2010.

International Search Report and written opinion issued in PCT/IB2010/052850, dated Oct. 4, 2010.

* cited by examiner

PROCESS FOR PRODUCING MICROFIBRILLATED CELLULOSE

This application is a U.S. National Stage under 35 U.S.C. §371 of International Application No. PCT/IB2010/053043, filed Jul. 2, 2010, which Claims priority from Swedish Patent Application No. 0950534-8 filed on Jul. 7, 2009.

FIELD OF THE INVENTION

The present invention relates to a process for producing microfibrillated cellulose by treating cellulosic fibres.

BACKGROUND

Cellulosic fibres are multi-component structures made from cellulose polymers, i.e. cellulose chains. Lignin, pentosans and other components known in art may also be present. The cellulose chains in the fibres are attached to each other to form elementary fibrils. Several elementary fibrils are bound to each other to form microfibrils and several microfibrils form aggregates. The links between the cellulose chains, elementary- and microfibrils are hydrogen bonds.

Microfibrillated cellulose (MFC) (also known as nanocellulose) is a material made from wood cellulose fibres, where the individual microfibrils have been detached from each other. MFC is normally very thin (~20 nm) and the length is often between 100 nm to 1 μm.

MFC can be produced in a number of different ways. It is possible to mechanically treat cellulosic fibres so that microfibrils are formed. However, it is very energy consuming method to for example shred or refine the fibres and it is therefore not often used.

The production of nanocellulose or microfibrillated cellulose with bacteria is another option. In contrast to the above, this is a bio-synthetic process starting from another raw material than wood fibres. However, it is a very expensive process and time consuming.

It is also possible to produce microfibrils from cellulose by the aid of different chemicals which will break or dissolve the fibres. However, it is difficult to control the length of the formed fibrils and the fibrils are often too short.

One example of production of MFC is described in WO2007091942. In the method described in WO20070912942, the MFC is produced by the aid of refining in combination with addition of an enzyme.

However, there is still a need for an improved process for the production of microfibrillated cellulose.

SUMMARY OF THE INVENTION

It is an object of the present invention to provide a process for production of microfibrillated cellulose in an improved and energy efficient way.

These objects and other advantages are achieved by the process according to claim 1. By mechanically pre-treating cellulosic fibres, followed by enzymatic treatment and addition of a solution comprising an alkali metal hydroxide and finally an additional mechanical treatment, it is possible to produce microfibrillated cellulose (MFC) in a very energy efficient way. This is achieved by the independent claim and preferred embodiments of the process are defined in the dependent claims.

The invention relates to a process for treating cellulosic fibres which process comprises mechanically pre-treating the fibres followed by treating the fibres with an enzyme and thereafter mixing the fibres with a solution comprising an alkali metal hydroxide in order to make the fibres expand. The expanded fibres are thereafter mechanically treated to form microfibrillated cellulose. In this way it is possible to produce MFC in an improved and energy efficient way.

The concentration of the alkali metal hydroxide can be between 4-18% of weight, preferably between 5-9% by weight. The concentration of the alkali metal hydroxide regulates the expansion of the fibres before the final mechanical treatment. The alkali metal hydroxide is preferably sodium hydroxide.

The solution comprising alkali metal hydroxide may also comprises a zinc salt. The combination of alkali metal hydroxide and zinc salt has been shown to improve expansion of the fibres. The zinc salt is preferably zinc oxide. The concentration of the zinc salt can be between 0.1-2% by weight preferably between 0.5-1.3% by weight.

The pre-treatment is preferably done by shredding or refining of the fibres. The pre-treatment opens the fibre structure before the treatment with the enzyme and the solution comprising alkali metal hydroxide. In this way the enzymatic treatment as well as the treatment with the solution comprising alkali metal hydroxide and zinc salt will be more effective and the expansion of the fibres will improve and thus also the production of MFC.

The consistency of the fibres during refining is preferably between 2.5-30% by weight.

It is also possible to add an enzyme before or during the pre-treatment in order to decompose the fibre structure. An enzyme which affects or breaks down hemicellulose is preferably used, for example xylanase but cellulase for example endogulcanase can also be used.

The temperature during the treatment with the solution may be between 0-15° C. Lower temperatures have been shown to increase the expansion of the fibres.

The enzyme used in the process is preferably cellulase which will decompose the cellulosic fibres and increase the accessibility and activity of the fibres and thus also the production of microfibrillated cellulose.

The cellulosic fibres are preferably fibres of kraft pulp.

DETAILED DESCRIPTION

The invention relates to a process for producing microfibrillated cellulose in an improved and energy efficient way.

It has been shown that the combination of mechanical pre-treatment followed by enzymatic treatment and addition of a solution comprising alkali metal hydroxide makes it possible to expand the fibres in a gentle and controlled way. Moreover, it has been shown that further mechanical treatment of the expanded fibres can be done in order to produce microfibrillated cellulose. By this process it has been shown that it is possible to produce MFC in a very controlled and cost efficient way.

The enzymatic treatment followed by addition of the solution comprising alkali metal hydroxide expands the fibres and it is by this treatment possible to control the expansion of the fibres. By using enzyme and the mentioned chemical/s it is possible to make small adjustments in, for example the concentrations, and in that way be able to control and regulate the extent of expansion of the fibres in a very precise way. The fibres expand due to that the hydrogen bonds between the cellulose chains are weakened. Even though the hydrogen bonds are weakened by the treatment, the fibres are otherwise quite unaffected. Thus, the strength of the fibres is thus not as decreased as after a purely mechanical treatment used in order to receive the same fibre length.

The enzyme will decompose the primary layer of the fibres and thus increase the accessibility of the fibres and is then able to penetrate the fibre structure and get in between the fibrils. The solution comprising alkali metal hydroxide will then be able to affect the fibre structure in a much more efficient way since the primary layer of the fibres is weakened. Some of the fibres will dissolve during the treatment with the solution comprising alkali metal hydroxide. When the alkali metal hydroxide content thereafter is decreased, the dissolved fibrils will go back to solid state. When the fibrils go back to solid state they will work as a glue and thus increase the bonding between the fibres and fibrils. Consequently, the produced MFC will have very good film forming properties.

The cellulosic fibres are pre-treated before the treatment with the enzyme and the solution comprising alkali metal hydroxide. The fibres are preferably shredded or refined in order to increase the specific surface area of the fibres before the enzymatic treatment and in this way facilitate and improve the effect of the enzymatic treatment. The shredding or refining may be done at a consistency between 2-40% by total weight. However, high consistency, preferably between 15-40% by total weight is often preferred. Low consistency, for example 2-6% by total weight or medium consistency, for example 10-20% of total weight can also be used.

It is also possible to add enzymes during the pre-treatment. It is then preferred to use enzymes which break down hemicellulose, such as xylanase but other enzymes such as cellulase for example endoglucanase can also be used. Enzymes may be added in order to further improve the pre-treatment and be able to decrease the extension of the mechanical treatment and thus save both the fibre strength and energy needed.

Other mechanical pre-treatments besides refining and shredding, such as beating, steam explosion, defibration, homogenization, ultrasonic treatment, dry cutting or other known mechanical fibre treatments in order to soften the fibres and make them more active and reactive before the following treatments can also be used.

After the pre-treatment, enzyme is added to the fibres which are in the form of a slurry which has a concentration of approximately 4-5%. The enzyme is added during stirring either in the beginning of the treatment or during the entire reaction time. The purpose with the enzymatic treatment is to break the hydrogen bonds between the microfibrils present in the slurry and thus enable expansion of the fibres. The enzyme increases the accessibility and the activity of the fibres and improves the following treatment with the solution.

The enzyme used can be any wood degrading enzymes which decompose cellulosic fibres. Cellulase is preferably used but other examples of usable enzymes are xylanase and mannanase. The enzyme is often an enzymatic preparation which can contain small parts of other enzymatic activities than the main enzyme of the preparation. The temperature used for the treatment with the enzyme may be between 30-85° C. However, it depends on the enzyme used and the optimal working temperature for that specific enzyme as well as other parameters of the treatment, such as time and pH. If cellulase is used, the temperature during the treatment may be approximately 50° C.

The enzymatic treatment may last for 30 minutes-5 hours. The time needed depends on the cellulosic fibres which are treated and on the activity of the enzyme as well as the temperature and the pH of the treatment. The activity of the enzyme may be 10-1000 nkat/g.

The enzymatic treatment can be terminated by either rising the temperature or the pH in order to denaturate the enzymes. As an alternative, if the solution comprising alkali metal hydroxide is added directly to the treated fibres, it is not necessary to denaturate the enzymes separately since the pH of the alkali metal hydroxide solution is high enough to terminate the enzymatic treatment. The pH during the treatment with the enzyme is preferably between 4-6.

The solution comprising alkali metal hydroxide is thereafter added to the enzyme-treated fibres to form a slurry. The slurry preferably has a concentration between 1-7% by total weight. The concentration of the alkali metal hydroxide may be between 4-18% by total weight, preferably between 5-9% by total weight. By total weight means the total weight of the slurry, i.e. the total weight of the solution and the pulp.

The solution may also contain a zinc salt. The combination of an alkali metal hydroxide and a zinc salt has been shown to be very efficient when expanding the fibres. The concentration of the zinc salt may be between 0.1-2% by total weight preferably between 0.5-1.3% by total weight.

If the solution comprises both alkali metal hydroxide and a zinc salt, the alkali metal hydroxide concentration and the zinc salt concentration are dependent of each other. For example, when there is a high alkali metal hydroxide concentration, less zinc salt is required. The amount of the alkali metal hydroxide and the zinc salt should be adjusted in a stepless manner inside their above determined ranges so optimum results can be reached. The alkali metal hydroxide concentration and the zinc salt concentration are thus dependent on each other in respect of the efficiency of expansion of the cellulosic fibres.

The temperature during the treatment with the solution may be between 0-15° C. Lower temperatures have been shown to increase the expansion of the fibres. However, it is important not to decrease the temperature too much since the dissolution of the fibres increases with decreased temperature. It is not desirable to dissolve the fibres so the temperature, as well as other parameters, must be controlled in order to only expand the fibres and not to dissolve them.

The alkali metal hydroxide is preferably sodium hydroxide but other alkali metal hydroxides, such as potassium hydroxide or a mixture of sodium hydroxide and potassium hydroxide or other alkali metal hydroxides can be used. The zinc salt is preferably zinc oxide, but other zinc salts such as zinc chloride or mixtures between different zinc salts can be used.

The pH during the treatment with the solution comprising alkali metal hydroxide or alkali metal hydroxide and zinc salt is preferably above 13. The treatment of the fibres with the solution comprising alkali metal hydroxide may last between 5 minutes to 2 hours depending on if the slurry is mixed during the treatment or not.

When the treatment with the solution is completed, the solution can be washed away with water or an acid. Before the addition of water or acid, low concentration sodium hydroxide, or another alkali metal hydroxide, can be added in order to remove the part with dissolved cellulose (if any) to be able to further use that part.

When the alkali metal hydroxide content decreases dissolved fibrils or particles will go back to solid state (as previously described). This regeneration of dissolved fibrils or particles occurs when the alkali metal hydroxide content is decreased. The decrease can either be accomplished by addition of water or acid or the produced slurry comprising the produced MFC can be mixed with another pulp slurry, for example in the wet end of a paper or board machine.

Dissolved cellulose is a clear or slightly turbid solution containing both dissolved cellulosic material and nanoparticles. The solid particles in the solution which we call dissolved should however be of the size that they can not be visible under a light microscope. Thus, the dissolved part also contains nano sized fibres and it should therefore also be recovered and used.

The solid part received by the process according to the invention and the dissolved part can be further treated either together or separately.

A drawback with the addition of water or acid is that the fibres tend to partially shrink, and it is advantageous to prevent such shrinkage. It can for example be prevented by defibrillating the fibres before addition of water or acid or by mechanical means making nano-cellulose before addition of water or acid. It is also possible to add chemicals that will prevent shrinkage. The choice of chemical is related to the end use of the expanded fibres. For example, surface active components, mechanical prevention by addition of bentonite or TiO2, by addition of CMC or starch or surfactants in order to "freeze" the fibre structure before addition of water or acid.

The fibres are thereafter mechanically treated in order to form microfibrillated cellulose. The time and temperature during such treatment varies depending on the fibres treated as well as on the previous treatments and are controlled in order to receive fibres with the desired fibre length. The mechanical treatment may be done by a refiner, defibrator, beater, friction grinder, high shear fibrilator (such as cavitron rotor/stator system), disperger, homogenizator (such as micro fluidizer) or other known mechanical fibre treatment apparatus.

The cellulosic fibres used in the process according to the invention are preferably fibres of kraft pulp, i.e. they have been treated according to the kraft process. It has been shown that the primary wall of the fibres in kraft pulp often prevents the fibres from expanding. Thus, it is necessary to remove the primary wall before the expanding treatment. The primary wall of the fibres can be removed by enhancing the pre-treatment of the fibres. Thus, increased refining, preferably high consistency refining has been shown to be very effective. Also, enzymes affecting hemicellulose can be used, either alone or in combination with refining, preferably high consistency refining. It is also possible to treat the fibres with enzymes before the refining of the fibres. However, other chemical pulps, mechanical pulps or chemi-mechanical pulps can also be used, one example is sulphite pulp. The fibres can also be bleached or unbleached, even though the bleached is preferred since the lignin content is decreased and the fibres expand more easily.

The cellulosic fibres may be hardwood and/or softwood fibres. It has been shown that sulphite pulps and pine kraft pulp disintegrate into smaller fractions when treated according to the invention compared to eucalyptus and birch kraft pulps. Thus, it is preferred to treat softwood fibres with the process according to the invention.

The cellulosic material produced according to the invention may be used for the production of films. MFC produced from softwood kraft pulps according to the process as described herein has been shown to achieve very good film forming properties.

Micro fibrillated cellulose (MFC) is often also referred to as nanocellulose. Fibres that has been fibrillated and which have microfibrills on the surface and microfibrils that are separated and located in a water phase of a slurry are included in the definition MFC.

Example

Birch kraft pulp was treated accordingly:

mechanical shredding for 5 hours at pulp consistency 20% enzymatic treatment with cellulase, 250 nkat/g, pH 5, 50° C., 3 hours.

The pulp was thereafter subjected to 9 wt % NaOH at 10° C. without intermediate drying to study its expanding ability. The wet pulp (cons. 20%) was added into NaOH at 10° C., the final content of the mixture was 5 wt % pulp and 9 wt % NaOH. The mixture was stirred for 15 minutes at 1000 rpm and thereafter left stable for 1 h 45 min at the same temperature. The sample was then studied under light microscope and the portion of soluble cellulose measured.

The expanded sample was purified by adding 4% NaOH, centrifuging the mixture and separating the clear/slightly turbid supernatant. The supernatant was treated with 10% $H_2SO_4$ to precipitate the dissolved cellulose. Thereafter, both the purified undissolved part and the precipitated dissolved part were further washed with water in dialysis. It was concluded that 42% of the fibres were dissolved.

Both the undissolved part and the precipitated dissolved part were thereafter subjected to high shear mixing at a consistency of about 1.5% for 10 minutes in order to produce MFC.

The total energy consumption when producing MFC as described in this example was about 0.3 MWh/t.

Prior art studies has shown that production of MFC by the aid of mechanical treatment is about 2-3 MWh/t according to prior art studies.

Consequently, the energy consumption has strongly decreased.

The invention claimed is:

1. A process for treating cellulosic fibres comprising:

mechanically pre-treating the fibres, treating the mechanically pre-treated fibres with an enzyme, mixing the enzymatically treated fibres with a solution comprising an alkali metal hydroxide and a zinc salt in order to make the fibres expand and adding a chemical selected from surface active agents, bentonite, $TiO_2$, or CMC to prevent shrinkage of the expanded fibres;

decreasing a concentration of the alkali metal hydroxide to regenerate dissolved fibrils or particles by adding water, or an acid after adding the chemical;

mechanically treating the expanded fibres to form microfibrillated cellulose.

2. A process for treating cellulosic fibres comprising:

mechanically pre-treating the fibres;

treating the mechanically pre-treated fibres with an enzyme;

mixing the enzymatically treated fibres with a solution comprising an alkali metal hydroxide and a zinc salt in order to make the fibres expand;

mechanically treating the expanded fibres to prevent shrinkage;

decreasing a concentration of the alkali metal hydroxide to regenerate dissolved fibrils or particles by adding water, or an acid after mechanically treating the expanded fibres; and mechanically treating the expanded fibres to form microfibrillated cellulose after decreasing the concentration of the alkali metal hydroxide.

3. The process according to claim 2 wherein the concentration of the alkali metal hydroxide is between 4-18% by total weight.

4. The process according to claim 2 wherein the concentration of zinc salt is between 0.1-2% by weight.

5. The process according to claim 2 wherein the fibres are mechanically pre-treated by shredding or refining.

6. The process according to claim 5 wherein the fibres are treated at a consistency of between 2.5-40% by total weight during the shredding or refining.

7. The process according to claim 2 wherein the temperature during the treatment with the solution is between 0-15° C.

8. The process according to claim 2 wherein the alkali metal hydroxide is sodium hydroxide.

9. The process according to claim 2 wherein the zinc salt is zinc oxide.

10. The process according to claim 2 wherein the enzyme is cellulase.

11. The process according to claim 2 wherein an enzyme affecting hemicellulose or an enzyme affecting cellulose is added before or during the mechanical pre-treatment of the fibres.

12. The process according to claim 2 wherein the fibres are fibres of kraft pulp.

13. The process according to claim 2 wherein the concentration of the alkali metal hydroxide is between 5-9% by total weight.

14. The process according to claim 2 wherein the concentration of zinc salt is between 0.5-1.3% by weight.

15. The process according to claim 11 wherein the enzyme affecting hemicelluloses is xylanase.

16. The process according to claim 11 wherein the enzyme affecting cellulose is cellulase.

17. The process according to claim 2 wherein a total energy consumption is less than a total energy consumption of a process without mixing the enzymatically treated fibres with the solution comprising the alkali metal hydroxide and the zinc salt.

18. The process according to claim 2 further comprising adding a chemical selected from the group consisting of surface active agents, bentonite, $TiO_2$, or CMC to prevent shrinkage of the expanded fibres.

* * * * *